US007874887B1

(12) United States Patent
Kruscic

(10) Patent No.: US 7,874,887 B1
(45) Date of Patent: Jan. 25, 2011

(54) FOREARM FLIPPER DEVICE FOR USE WITH SWIMMING

(76) Inventor: Mirko Kruscic, 55 Triller Avenue, Apt. #2114, Toronto, Ontario (CA) M6R 2H6

( * ) Notice: Subject to any disclaimer, the term of this patent is extended or adjusted under 35 U.S.C. 154(b) by 172 days.

(21) Appl. No.: 12/361,095

(22) Filed: Jan. 28, 2009

(51) Int. Cl.
*A63B 31/12* (2006.01)

(52) U.S. Cl. ..... 441/59

(58) Field of Classification Search ..... 441/55, 441/56, 59, 60
See application file for complete search history.

(56) References Cited

U.S. PATENT DOCUMENTS

| | | | | |
|---|---|---|---|---|
| 377,638 | A | 2/1888 | Petersen | |
| 689,085 | A * | 12/1901 | Hooper | 441/59 |
| 1,548,054 | A * | 8/1925 | Meadows | 441/59 |
| 2,325,453 | A | 7/1943 | Wener | |
| 2,898,611 | A | 8/1959 | Mooney | |
| 3,097,375 | A * | 7/1963 | Griffith | 441/57 |
| 3,107,371 | A * | 10/1963 | Thompson | 441/59 |
| 3,827,095 | A * | 8/1974 | Feather | 441/59 |
| 4,756,699 | A * | 7/1988 | Brom | 441/59 |
| 4,944,703 | A | 7/1990 | Mosier | |
| 5,087,217 | A | 2/1992 | Tuan et al. | |
| 5,326,296 | A | 7/1994 | De Jesus | |
| 5,338,235 | A | 8/1994 | Lee | |
| D398,362 | S | 9/1998 | Larmont | |
| 6,871,420 | B2 | 3/2005 | Shikhashvili | |

* cited by examiner

*Primary Examiner*—Daniel V Venne
(74) *Attorney, Agent, or Firm*—Kyle Fletcher

(57) ABSTRACT

The invention is a forearm device for use with swimming that comprises housing and a plurality of flippers that are capable of rotating to a perpendicular direction when in the water and parallel with the housing when out of the water. The invention is designed to further propel the swimmer. The flippers and housing may be made of a lightweight material that is buoyant.

6 Claims, 4 Drawing Sheets

FOREARM FLIPPER DEVICE FOR USE WITH SWIMMING

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of a device that is worn about a forearm and of which aides the swimmer during swimming.

B. Discussion of the Prior Art

As a preliminary note, it should be stated that there is an ample amount of swimming aides. As will be discussed below, no piece of prior art discloses a flipper device that is worn about the swimmer's forearm.

The De Jesus patent (U.S. Pat. No. 5,326,296) discloses a swimmer's aid comprising a device that is attachable to a user's limb in which the device includes a plurality of flexing fin members that move opposite of the kick of a swimmer's leg. However, the device is not suited about a swimmer's forearm and of which the extending fins do not rotate back when the arm is out of the water, and thereafter rotate forward when in the water in order to reduce drag when not in the water.

The Mosier patent (U.S. Pat. No. 4,944,703) discloses a swim fin having a foot receptacle for attaching to a swimmer's or diver's foot. A pair of parallel beam supports is secured to the foot and toe portion of the foot receptacle and support a plurality of hydrofoil blades there between in a pivotal attachment. However, the device is suited for use with a flipper of a foot as opposed to a forearm of a swimmer.

The Shikhashvili patent (U.S. Pat. No. 6,871,420) discloses a shoe having fin members for aiding in swimming. However, the shoe is not adapted for use with a swimmer's forearm.

The Wener patent (U.S. Pat. No. 2,325,453) discloses a device adaptable to a swimmer's leg that includes plates, which are spread outwardly on a forward stroke so that a large propelling force may be exerted by the swimmer. Again, the device is adapted for use with a leg, and not the forearm of a swimmer.

The Lee patent (U.S. Pat. No. 5,338,235) discloses a swimming aid, wherein said aid comprises a fin that is flexible and adapted in use to be fitted to a portion of the anatomy of the user. Again, the device is adapted for use with a leg, and not the forearm of a swimmer.

The Tuan et al. patent (U.S. Pat. No. 5,087,217) discloses a swimming shoe that has water-resistant flanges on the shoe body that enable a swimmer to remain afloat in the water. However, the device is adapted as a flotation device for use with a leg and foot, and not a device that assists in propelling the swimmer about the forearm.

The Mooney patent (U.S. Pat. No. 2,898,611) discloses a swimming aid having multiple flipper members. Again, the device is adapted for use with a leg, and not the forearm of a swimmer.

The Boyers patent (U.S. Pat. No. 2,792,577) discloses a swimmer's sock having folding leaves for propelling the swimmer. Again, the device is adapted for use with a leg, and not the forearm of a swimmer.

The Petersen patent (U.S. Pat. No. 377,638) discloses a swimming apparatus having folding leaves for propelling the swimmer. Again, the apparatus is adapted for use with a leg, and not the forearm of a swimmer.

The Larmount patent (U.S. Pat. No. Des. 398,362) illustrates an ornamental appearance for a swimming aid, which does not depict a plurality of plates that can rotate.

While the above-described devices fulfill their respective and particular objects and requirements, they do not describe a forearm flipper device that has a plurality of flippers that rotate back when the device is out of the water and forward when engaged upon the water in order to propel the swimmer. In this regard, the forearm device for use with swimming departs from the conventional concepts and designs of the prior art.

SUMMARY OF THE INVENTION

The invention is a forearm device for use with swimming that comprises housing and a plurality of flippers that are capable of rotating to a perpendicular direction when in the water and parallel with the housing when out of the water. The invention is designed to further propel the swimmer. The flippers and housing may be made of a lightweight material that is buoyant.

It is an object of the invention to provide a flipper device for use with a swimmer's forearm.

A further object of the invention is to provide a plurality of flippers that rotate back when out of the water.

A further object of the invention is to provide a device that is easy to use with any of a plurality of swimming strokes.

A further object of the invention is to provide a device that is effective, lightweight, and affordable.

These together with additional objects, features and advantages of the forearm device for use with swimming will be readily apparent to those of ordinary skill in the art upon reading the following detailed description of presently preferred, but nonetheless illustrative, embodiments of the forearm device for use with swimming when taken in conjunction with the accompanying drawings.

In this respect, before explaining the current embodiments of the forearm device for use with swimming in detail, it is to be understood that the forearm device for use with swimming is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the forearm device for use with swimming. It is therefore important that the claims be regarded as including such equivalent construction insofar as they do not depart from the spirit and scope of the forearm device for use with swimming. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
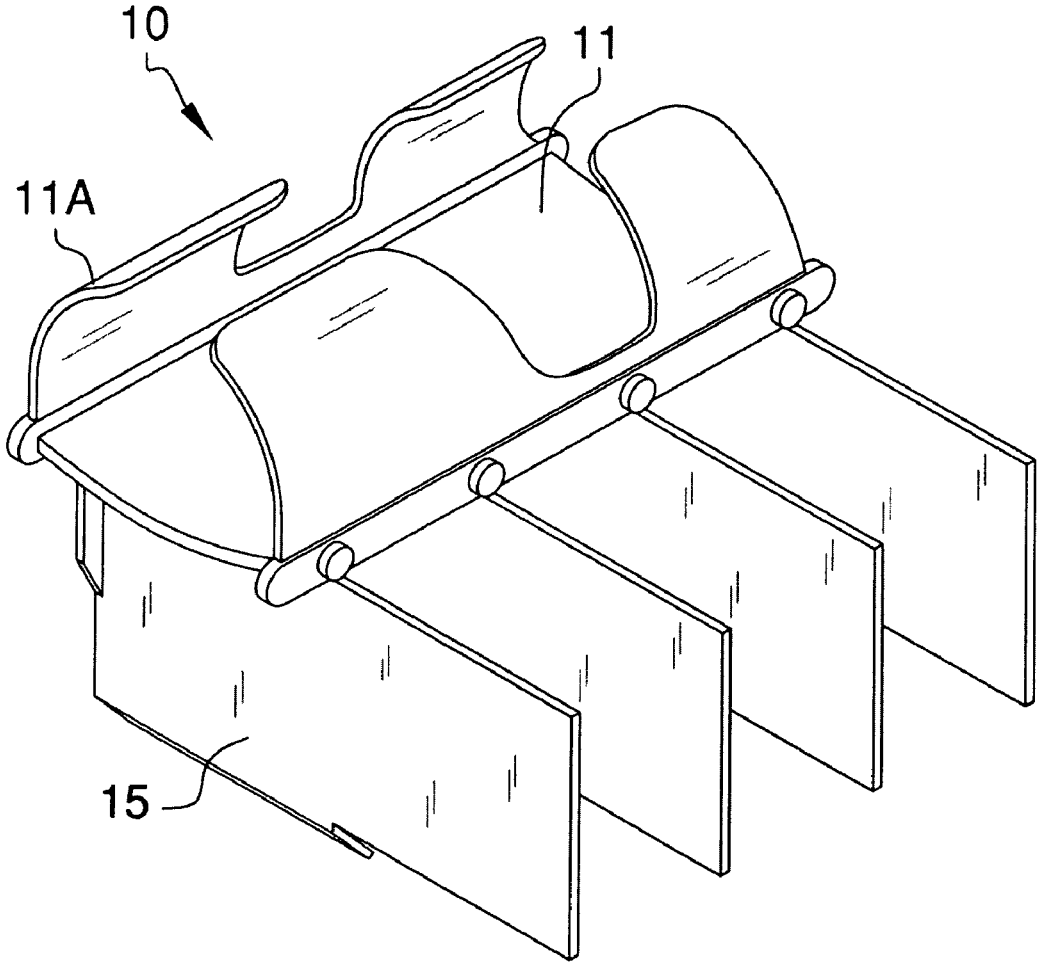
FIG. 1 illustrates a top, isometric view of the invention with the flippers extended.
Figure 2:
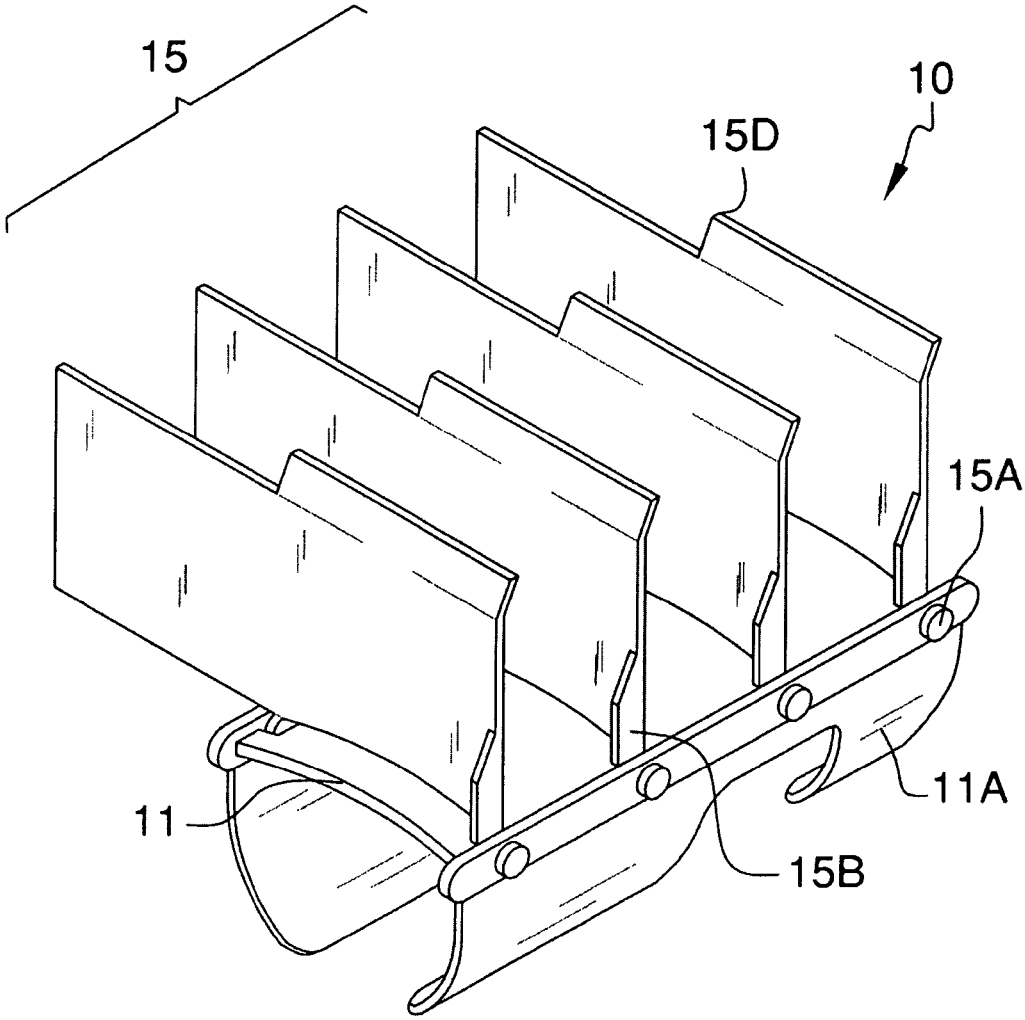
FIG. 2 illustrates a bottom, isometric view of the invention with the flippers extended.
Figure 3:
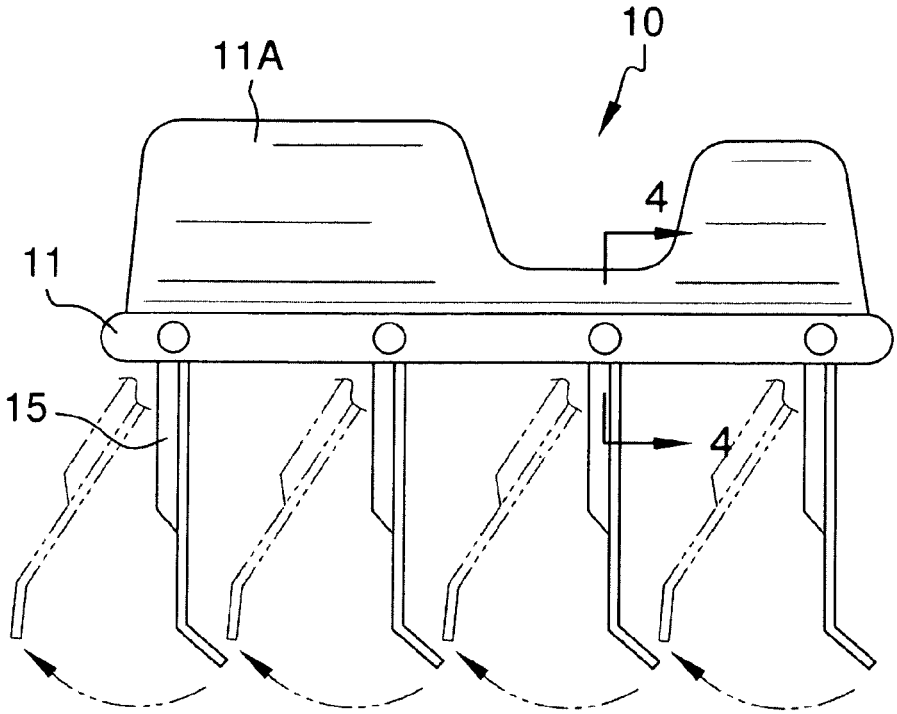
FIG. 3 illustrates a side view of the invention detailing the full range of rotational movement of the plurality of flippers.
Figure 4:
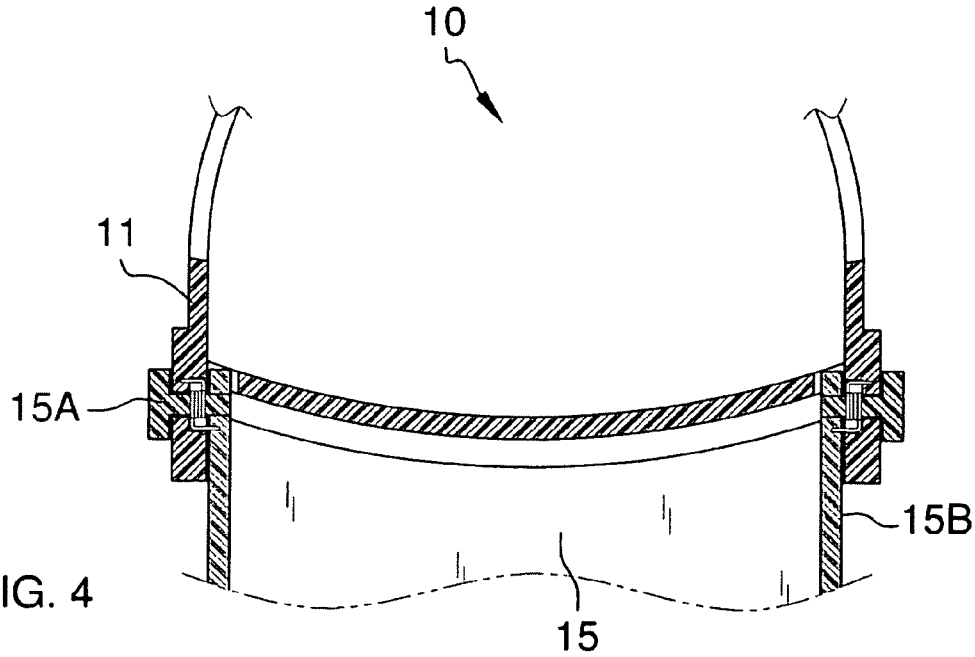
FIG. 4 illustrates a cross-sectional view of the invention along line 4-4 in FIG. 3.

Detailed reference will now be made to the preferred embodiment of the present invention, examples of which are illustrated in FIGS. 1-4 and 6. A forearm device for use with swimming 10 (hereinafter invention) includes a housing 11 and a plurality of flippers 15. Each flipper 15 has a pivoting pin 15A of which the flipper 15 may rotate about the housing 11, as depicted in FIGS. 3-4.

It is important to note that the flippers 15 may rotate from a perpendicular position, as depicted in FIGS. 1-2, to a flat position (not shown), which results in a range of motion not to exceed 90 degrees.

The housing 11 has arm supports 11A on each side, which enable a forearm 30 of a swimmer to be inserted and secured about. It shall be noted that straps (not shown) may be used in addition to or alone as a means to secure the housing 11 about the forearm 30.

The flippers 15 have located on each side a side wall 15B, which aids in directing water across the surface of the flipper 15.

Each pivoting pin 15A has a spring coil 15C that imposes a biasing force against the housing 11 and the flippers 15 in order to extend the flipper 15 generally parallel with the housing 11. The flippers 15 are capable of rotating to a perpendicular position, see right forearm in FIG. 6, when in use in water. However, the flippers 15 rotate back when out of the water, see left forearm in FIG. 6.

Each flipper 15 also has an angled flange 15D, which improves the overall effectiveness of the flipper 15.

The housing 11 and the flippers 15 may be made of a material that is buoyant. Additionally, the housing and the flippers 15 may be made of a material comprising a plastic, metal, or wood.

Figure 5:
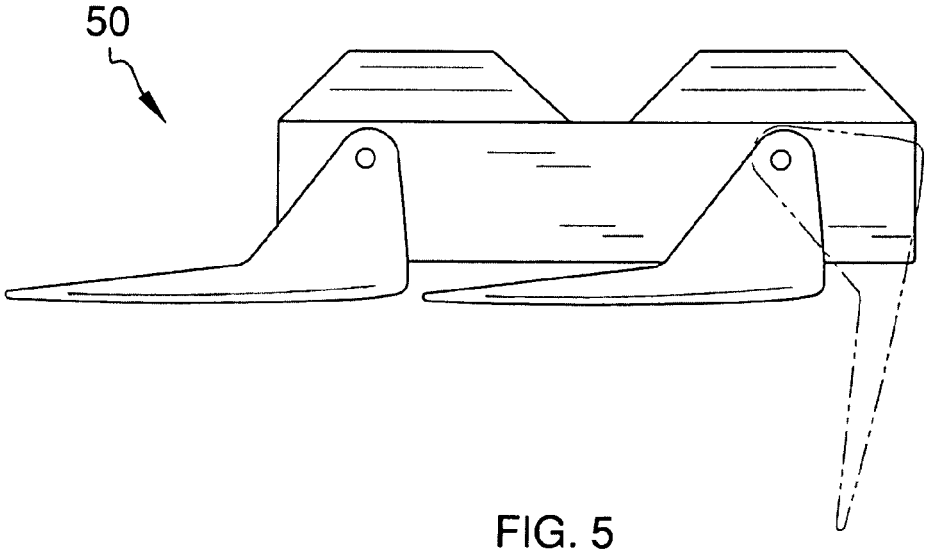
FIG. 5 illustrates a side view of an alternative embodiment that has a plurality of flippers.
Figure 6:
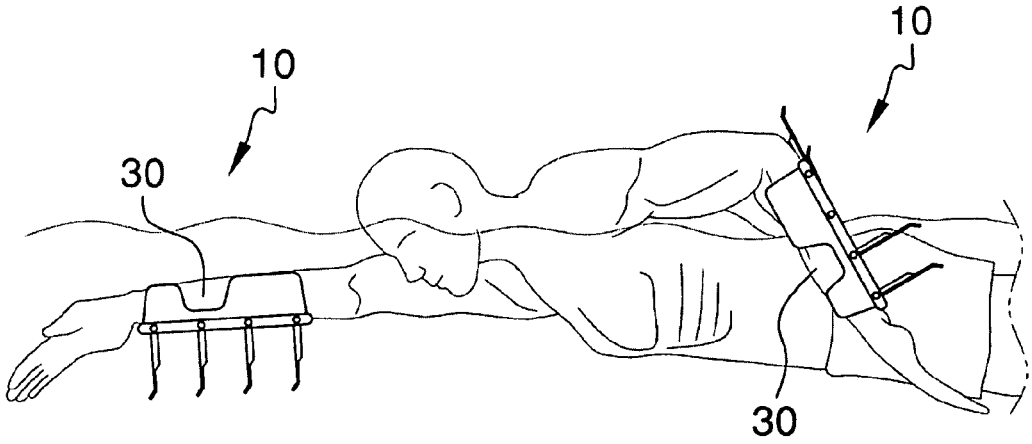
FIG. 6 illustrates a view of the invention in use.

Referring to FIG. 5, an alternative embodiment 50 comprises the same components and variations as the invention 10.

With respect to the above description, it is to be realized that the optimum dimensional relationship for the various components of the invention 10 and alternative embodiment 50, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 10 and the alternative embodiment 50.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The invention claimed is:

1. A forearm device for use with swimming comprising:

(a) a housing;

wherein the housing has a pair of forearm supports to secure the housing about a forearm of a swimmer;

(b) a plurality of flippers;

wherein each flipper has a flat surface that spans a length of the flipper itself;

wherein the flippers are aligned with one another and mounted along a side of the housing opposite the securing means;

wherein the flippers can rotate from a position perpendicular with the forearm to a position parallel with the forearm;

wherein the flippers have a side wall located along each side of the flat surface of the flipper in order to channel water across a surface of the flipper;

wherein the flipper has a flanged end that spans across an outermost end of and along the entire length or less than an entire length of the flat surface of the flipper.

2. The forearm device for use with swimming as described in claim 1 wherein the housing and the flippers are made from a buoyant material.

3. The forearm device for use with swimming as described in claim 2 wherein the housing and the flippers are made from a material comprising a plastic, wood, or metal.

4. A forearm device for use with swimming comprising:

(a) a housing;

wherein the housing has a pair of forearm supports to secure the housing about a forearm of a swimmer;

(b) a plurality of flippers;

wherein each flipper has a flat surface that spans a length of the flipper itself;

wherein the flippers are aligned with one another and are mounted by a pivoting pin along a side of the housing opposite the securing means;

wherein the flippers can rotate from a position perpendicular with the forearm to a position parallel with the forearm;

wherein the flippers have a side wall located along each side of the flat surface of the flipper in order to channel water across a surface of the flipper;

wherein the flipper has a flanged end that spans across an outermost end of and along the entire length or less than an entire length of the flat surface of the flipper;

wherein the pivoting pin has a spring coil that imposes a biasing force that extends the flippers perpendicular with the housing.

5. The forearm device for use with swimming as described in claim 4 wherein the housing and the flippers are made from a buoyant material.

6. The forearm device for use with swimming as described in claim 5 wherein the housing and the flippers are made from a material comprising a plastic, wood, or metal.

* * * * *